US006634110B2

(12) United States Patent
Johnson

(10) Patent No.: US 6,634,110 B2
(45) Date of Patent: Oct. 21, 2003

(54) ARCHERY BOW SIGHT

(75) Inventor: Steven C. Johnson, Harrisburg, OR (US)

(73) Assignee: Center Spot, Inc., Harrisburg, OR (US)

( * ) Notice: Subject to any disclaimer, the term of this patent is extended or adjusted under 35 U.S.C. 154(b) by 0 days.

(21) Appl. No.: 09/747,482

(22) Filed: Dec. 20, 2000

(65) Prior Publication Data

US 2002/0073559 A1 Jun. 20, 2002

(51) Int. Cl.[7] ..... F41G 1/00
(52) U.S. Cl. ..... 33/265
(58) Field of Search ..... 33/265; 124/87

(56) References Cited

U.S. PATENT DOCUMENTS 3,798,783 A * 3/1974 Carella ..... 33/265
4,309,827 A * 1/1982 Larson ..... 33/265
4,543,728 A * 10/1985 Kowalski ..... 33/265
4,961,265 A * 10/1990 Roberts ..... 33/265
4,982,503 A * 1/1991 Land ..... 33/265
5,201,123 A * 4/1993 Booe ..... 33/265
5,231,765 A * 8/1993 Sherman ..... 33/265
5,289,814 A * 3/1994 Maisano ..... 33/265
6,026,799 A * 2/2000 Wiseby et al. ..... 33/265
6,098,608 A * 8/2000 Oshlick ..... 33/265
6,311,405 B1 * 11/2001 Slates ..... 33/265

* cited by examiner

*Primary Examiner*—Diego Gutierrez
*Assistant Examiner*—Travis Reis
(74) *Attorney, Agent, or Firm*—Chernoff, Vilhauer, McClung & Stenzel, LLP

(57) ABSTRACT

A bow sight provides horizontal, vertical and at least one rotational adjustment mechanism which provides continuous movement of the sight ring without having to release a locking mechanism and still not allow unintentional movement of the sight ring. The sight has a plurality of sight pins having illuminated tips located at spaced-apart locations along a vertical sight line which extends across the sight ring. First adjustment mechanisms allow the sight pins to be rotated in order to set the location of the tips along the sight line and second adjustment mechanisms allow the sight pins to be moved along their longitudinal axes to align them with the sight line after they have been rotated. The sight also includes particular horizontal and vertical micro adjustment mechanisms which allow very small movements of the sight ring in the horizontal and vertical directions without having to release a locking mechanism.

13 Claims, 5 Drawing Sheets

ARCHERY BOW SIGHT

BACKGROUND AND SUMMARY OF THE INVENTION

The subject invention relates to a bow sight and particularly to a bow sight which is completely adjustable without the necessity of unlocking locking mechanisms in order to make the adjustments.

Bow sights have a mounting bracket which is attachable to the riser of the bow, a mounting arm which extends forwardly from the bracket and a sight ring, which contains one or more sight pins, which is attached to the mounting arm. In order for a bow sight to work with different bows the sight ring needs to be adjustable. Typically the sight ring is moveable forward and backward relative to the bow and inward and outward and upward and downward relative to the mounting arm. In addition the sight ring may be rotatable about a horizontal axis which is coaxial with the mounting arm. Finally the sight ring may be rotatable about a vertical axis which bisects the mounting arm. An exemplary bow sight is shown in Rudovsky, U.S. Pat. No. 5,303,479. In the past bow sight adjustment mechanisms had locking devices which had to be released to make the adjustment, in order to prevent inadvertent movement of the sight ring during handling and shooting of the bow. This is cumbersome. In addition, the previous adjustment mechanisms themselves were loose so significant movement could occur when the locking mechanism was unlocked. Since bow sight adjustment is done by trial and error, coming closer and closer to the desired point, movement during unlocking made it difficult to ever reach the desired point. This problem was recently overcome by Gibbs, U.S. Pat. No. RE36,266. Gibbs provides a vertical micro adjustment mechanism which does not require a locking mechanism and yet does not inadvertently move during use of the bow. However, the Gibbs adjustment mechanism utilizes a ball screw adjustment which is quite expensive. Gibbs also provides a horizontal adjustment mechanism which does not require a locking mechanism, but the horizontal adjustment system in Gibbs does not completely prevent inadvertent movement during use of the bow.

In addition, none of the prior art bow sights of the type having multiple sight pins using fiber optics to provide an illuminated tip have a way to adjust the separation of the tips without undoing a locking mechanism.

In one aspect, the subject invention overcomes the shortcomings and limitations of the prior art bow sights by providing horizontal, vertical and at least one rotational adjustment mechanism which allows continuous movement of the sight ring without having to release a locking mechanism, and still prevents unintentional movement of the sight ring. In another preferred aspect, the bow sight of the subject invention provides a plurality of sight pins having distal ends with illuminated tips and proximal ends which are rotatably mounted in the sight ring. A first adjustment mechanism allows the sight pins to be rotated to set the location of the illuminated tips along a vertical sight line in the sight ring. A second adjustment mechanism allows the sight pins to be moved along their longitudinal axes to align them with the sight line when they have been rotated.

In another preferred aspect of the invention, horizontal and vertical micro adjustment mechanisms include a pair of rails which extend across a cavity in a housing. A guide has a pair of tracks which engage the rails and allow the guide to be moveable across the cavity on the rails. A threaded rod which extends across the cavity parallel with the rails passes through a threaded cavity in the center of the guide. Thus, rotation of the threaded rod causes the guide to move along the tracks. The tracks tightly engage the rails and the threaded opening resists rotation of the threaded rod which prevent inadvertent movement of the guide along the rails.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
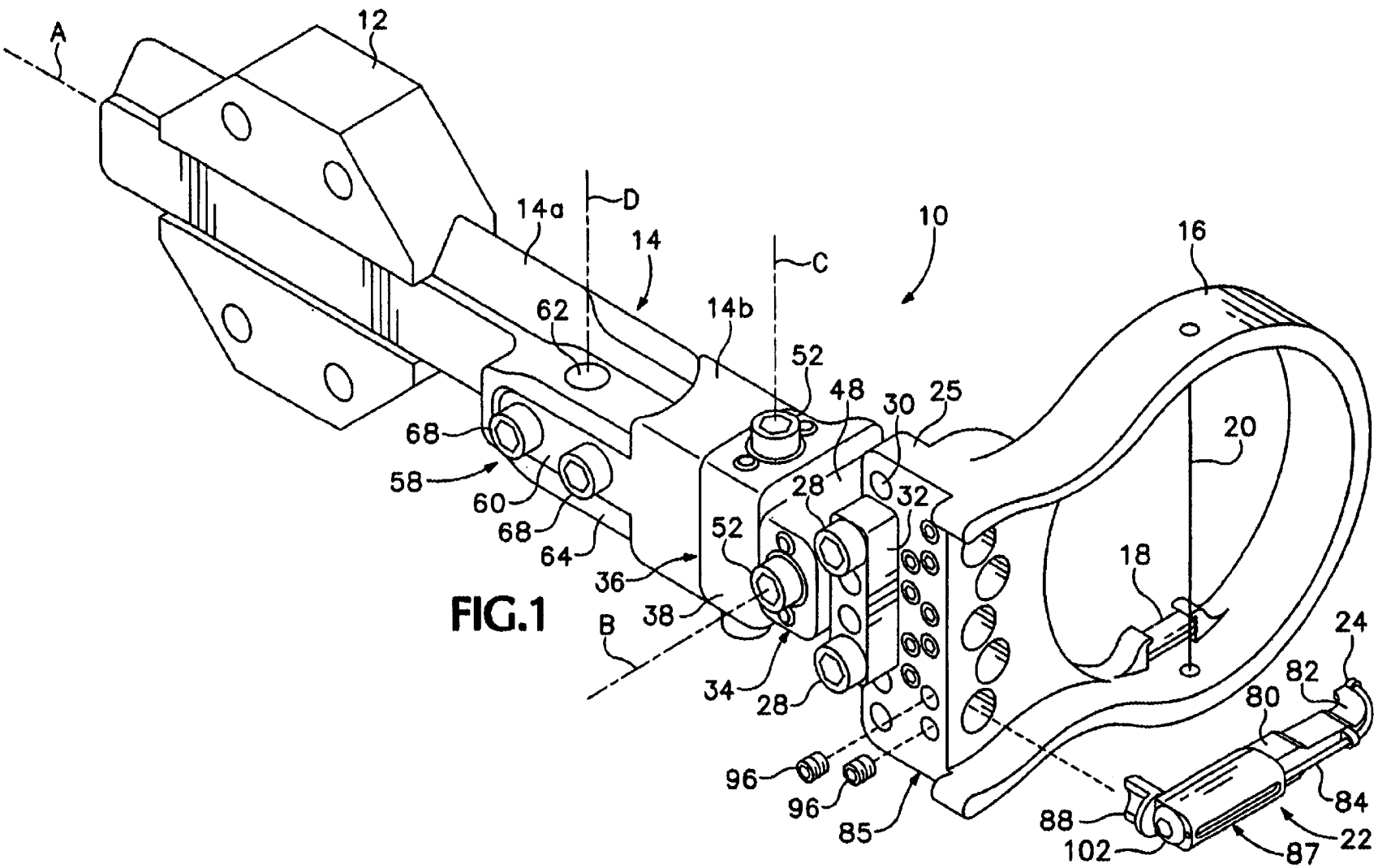
FIG. 1 is a partially exploded perspective view of a bow sight embodying the subject invention.

Referring to FIG. 1 of the drawings, an archery bow sight 10 includes a mounting bracket 12 which attaches to a bow riser, not shown, by conventional means. One end of a mounting arm 14, which is slidably mounted in the mounting bracket, can be attached to the mounting bracket at the desired location along its elongate center line "A" by means of a set screw, not shown. The other end of the mounting bracket is attached to a sight ring 16 through a series of adjustment mechanisms, which will be described in more detail later. The sight ring 16 has a bubble level 18 at its bottom. The sight ring is oriented relative to the bow such that when the bubble is centered in the level 18 the elongate axis of the bow is oriented vertically. A sight line 20 extending across the sight ring is vertical when the bubble is centered in the bubble level 18. A plurality of sight pins 22 mounted on the sight ring have illuminated tips 24 which are located at spaced-apart locations along the sight line. The sight ring has a base 25 which is attached to a tab 26, FIG. 2, at the end of the mounting arm by means of screws 28 which fit into threaded holes in the tab 26. The base 25 has a series of holes 30 in it, which allows a course adjustment of the sight ring vertically relative to the mounting arm 14. The horizontal location of the sight ring 16 relative to the mounting arm can be coarsely adjusted by mounting the base 25 on the appropriate side of the tab 26 and by either placing or not placing a spacer 32 between the base and the tab.

In addition to the coarse vertical and horizontal adjustments of the sight ring, there is a horizontal micro adjustment mechanism 34 which provides almost infinite adjustment of the location of the sight ring along a first axis "B," which is horizontal when the elongate axis of the bow is oriented vertically, and a vertical micro adjustment mechanism 36 which provides almost infinite adjustment of the location of the sight ring along a second axis "C" which is vertical when the elongate axis of the bow is oriented vertically. One side of the horizontal micro adjustment mechanism 34 is connected to the tab 26 and the other side is connected to the vertical micro adjustment mechanism 36. One side of the vertical micro adjustment mechanism 36 is attached to the horizontal micro adjustment mechanism 34 and the other side is attached to the mounting arm 14. Other than how they are attached to their adjacent elements, the horizontal and vertical micro adjustment mechanisms are identical and only the vertical micro adjustment mechanism 36 will be described.

Figure 3:
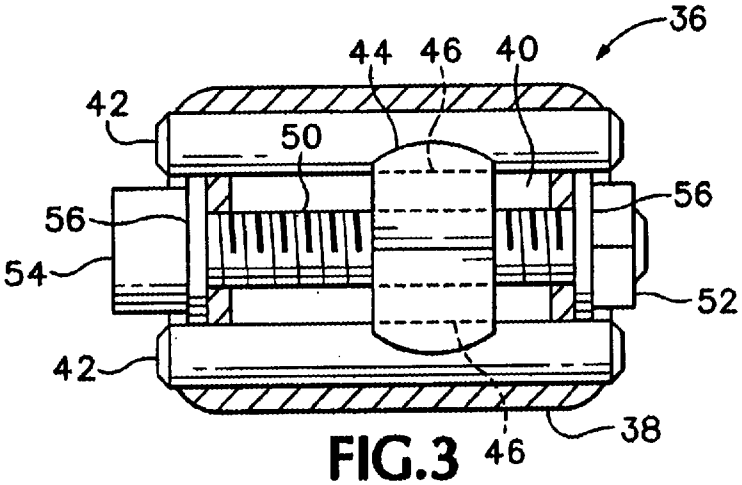
FIG. 3 is a sectional view taken on the line 3—3 and FIG. 2.
Figure 4:
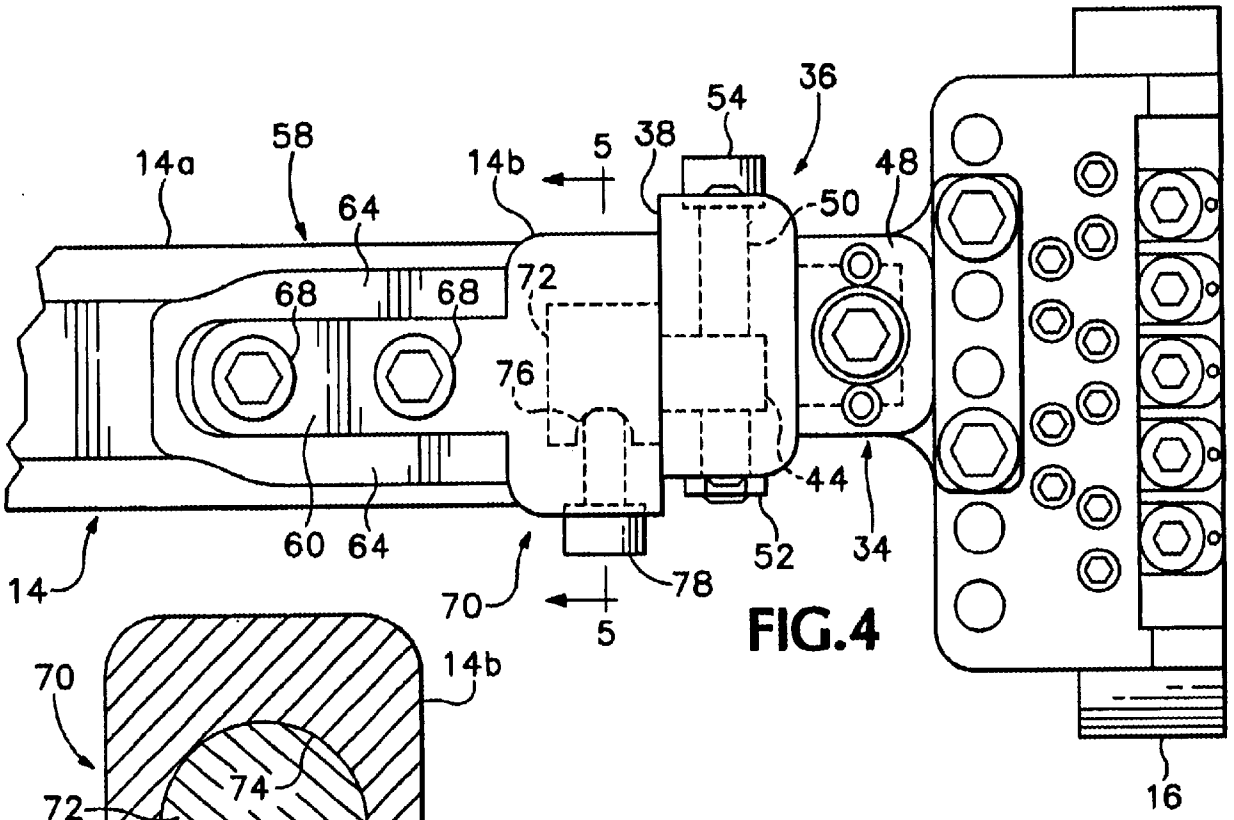
FIG. 4 is a partial side elevational view of the bow sight.

Referring now also to FIGS. 3 and 4, the vertical micro adjustment mechanism 36 includes a housing 38 having a central cavity 40. Extending across the cavity are a pair of rails 42 which are separated from one another. A guide 44 has a pair of tracks 46 formed in it which engage the rails so that the guide can move back and forth across the cavity on the rails. The rails and tracks are configured such that the guide is tightly engaged by the rails. Thus, it takes considerable force to slide the guide along the rails and the guide is prevented from moving in any other direction other than along the rails. The guide 44 is attached to the mounting arm 14 so as the guide is moved along the rails the housing 38 moves vertically relative to the mounting arm. The guide 44 in the horizontal micro adjustment mechanism 34 is attached to the housing 38. Thus, as it is moved, the housing 48 of the horizontal micro adjustment member 34 is moved horizontally relative to the housing 38 of the vertical micro adjustment member 36. Since the vertical micro adjustment member does not move horizontally relative to the mounting arm 14, movement of the guide in the horizontal micro adjustment mechanism 34 causes its housing 48 to move horizontally with respect to the mounting arm.

The guide 44 has a threaded opening 50 extending through it parallel with the rails 14. A threaded rod 50, which is rotatably mounted in the housing 38, extends across the cavity 40 and through the threaded opening in the guide 44. The threaded opening and threaded rod also tightly engage one another so that while rotating the threaded rod will cause the guide to move along the rails, there will not be inadvertent movement of the guide. Thus, it is not necessary to have a locking mechanism which needs to be released before adjustment of the horizontal and vertical micro adjustment mechanisms, and very fine adjustments can be made. In a preferred embodiment the tight engagement is achieved by placing a locking HELI-COIL in the threaded opening. In the embodiment illustrated the threaded rod is a bolt. The head 52 of the bolt is located on one side of the housing 38 and a nut 54 is placed on the bolt at the other side of the housing. The nut is tightened snugly on the bolt and then the threads next to the nut are preened to set the nut on the bolt. Thus, the bolt turns tightly in the housing 38 which further prevents inadvertent movement of the guide 44. A washer 56 is placed between the nut 52 and the housing and another washer 56 is placed between the bolt head 54 and the housing to prevent rotation of the bolt from damaging the housing.

Figure 2:
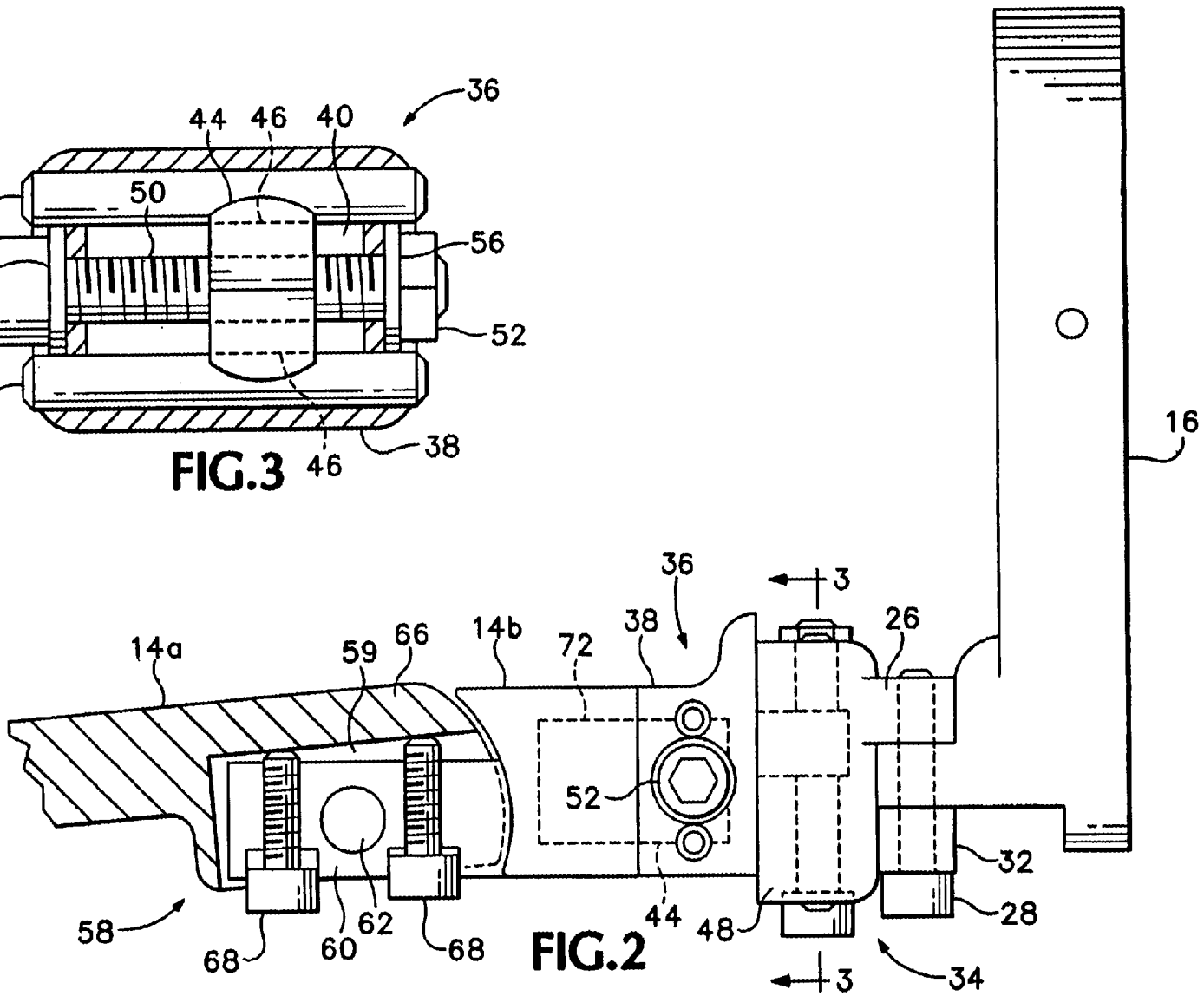
FIG. 2 is a partial plan view of the bow sight of FIG. 1.

In addition to the horizontal and vertical adjustability of the sight ring, the bow sight has a vertical axis rotational adjustment mechanism 58 which allows the sight ring to be rotated about a third axis "D" which bisects the mounting arm and is vertical when the bow is held with its longitudinal axis vertical. The vertical axis rotational adjustment mechanism 58 is best seen in FIGS. 1 and 2. The mounting arm 14 is divided into a first arm section 14*a*, which is attached to the mounting bracket 12, and a second arm section 14*a*, which is connected to the vertical micro adjustment mechanism 36. The first arm section 14*a* has a slot 59 located on one side, and the second arm section 14*b* has a finger 60 which fits into the slot 59. A pin 62, which is centered on the third axis "D," extends through the sides 64 of the first arm section which form the slot 59 and the finger 60 to rotatably join the first and second arm sections together. There is a slight gap between the bottom of the finger 60 and the bottom of the slot 59, which allows the finger to rotate on the pin. In addition, the finger 60 overlaps the bottom 66 of the slot. The finger has a pair of threaded passageways extending through it, one on each side of the pin 62. Screws 68 fit into the threaded passageways. When both screws are tightened against the bottom of the slot 66 the finger is prevented from rotating about the pin 62. If one of the screws is slightly loosened and the other screw is slightly tightened the finger is rotated slightly. Thus, like the micro adjustment mechanisms, the vertical axis rotational adjustment mechanism does not have a locking system which needs to be locked to make adjustments and almost infinite adjustment is available.

Figure 5:
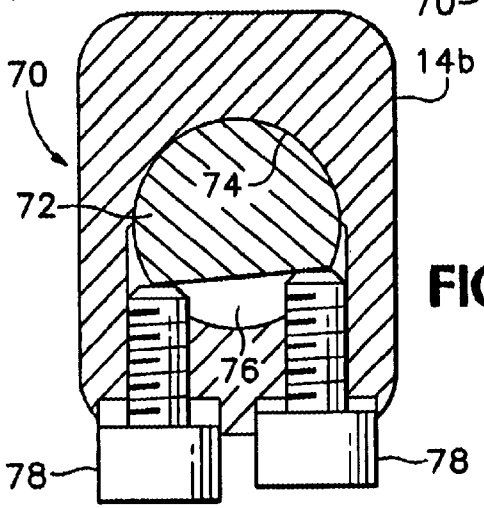
FIG. 5 is a sectional view at an enlarged scale taken on the line 5—5 of FIG. 4.
Figure 7:
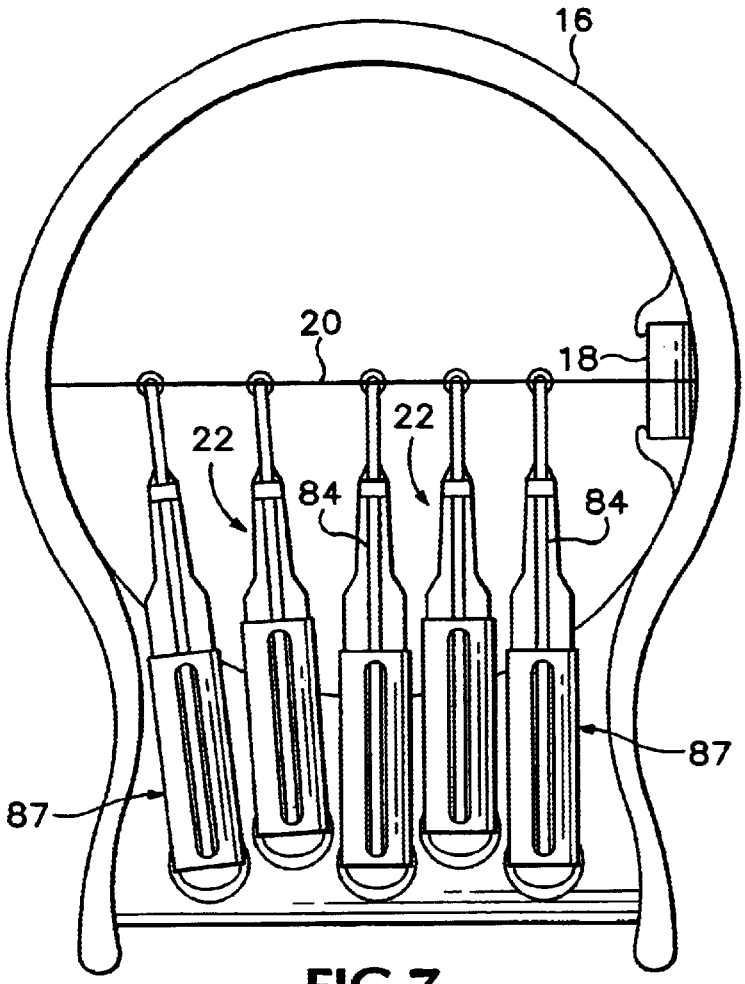
FIG. 7 is an elevation view taken along the line 7—7 in FIG. 6.
Figure 6:
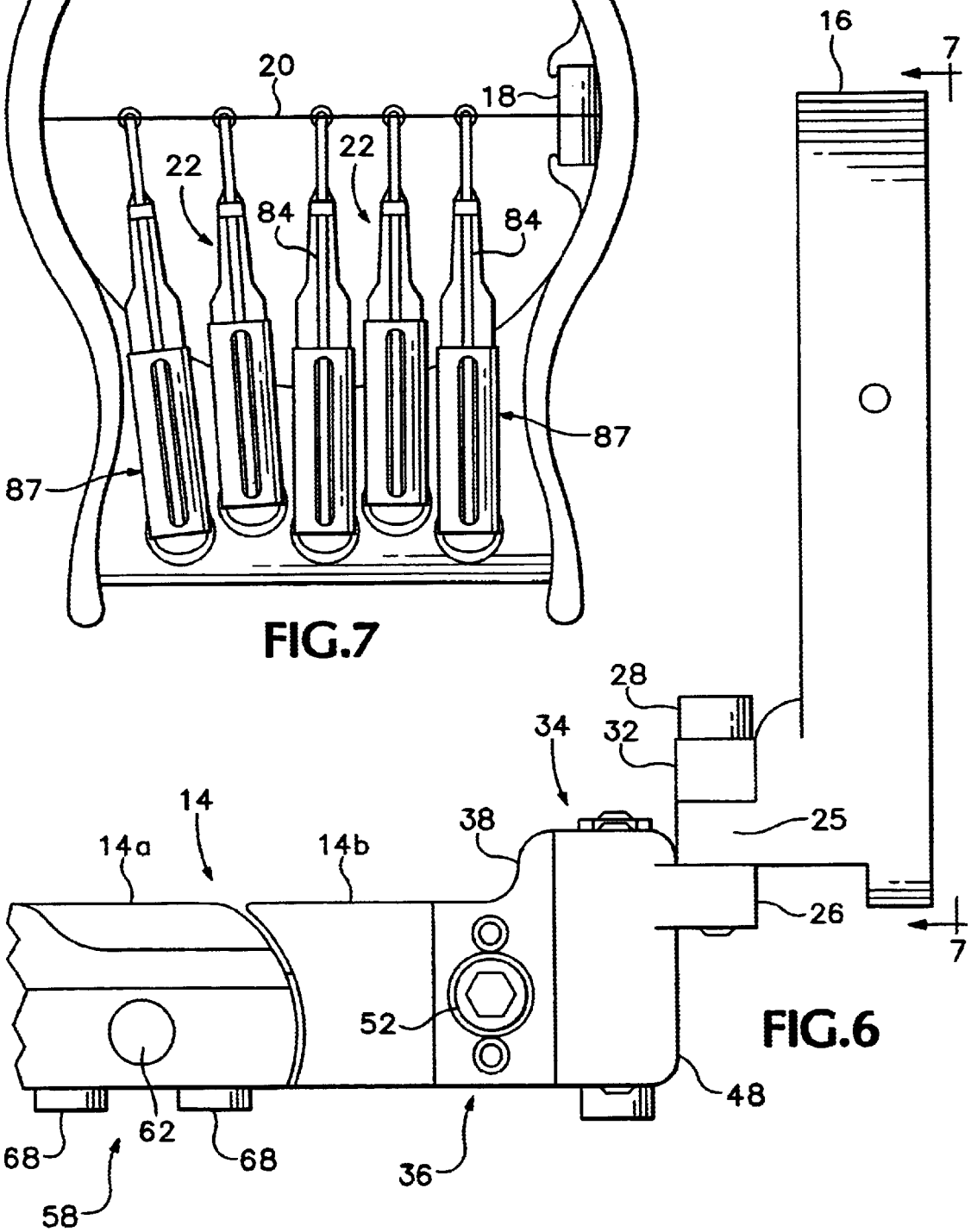
FIG. 6 is a partial plan view of the bow sight.
Figure 8:
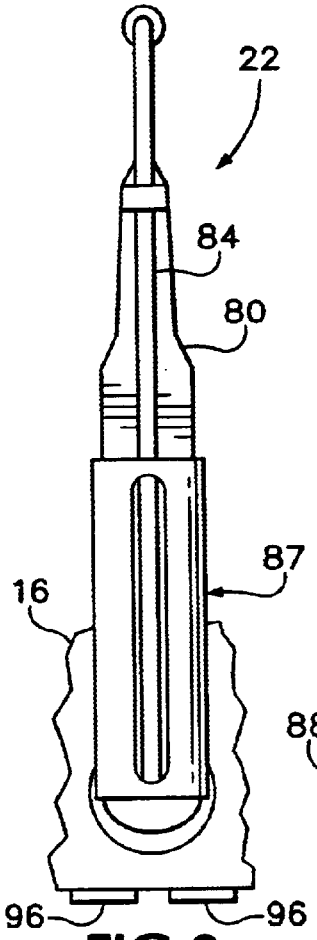
FIG. 8 is a plan view of one of the sight pins of the subject invention.
Figure 9:
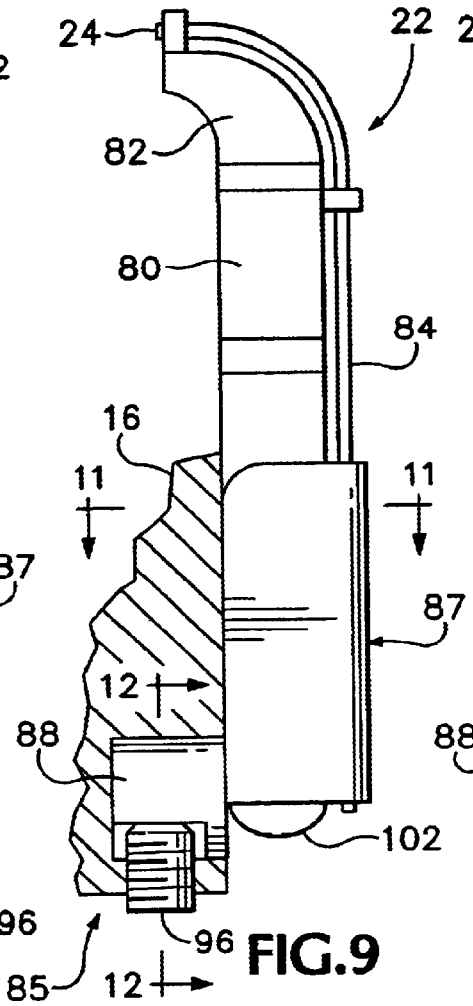
FIG. 9 is a side elevational view of the sight pin of FIG. 8.
Figure 10:
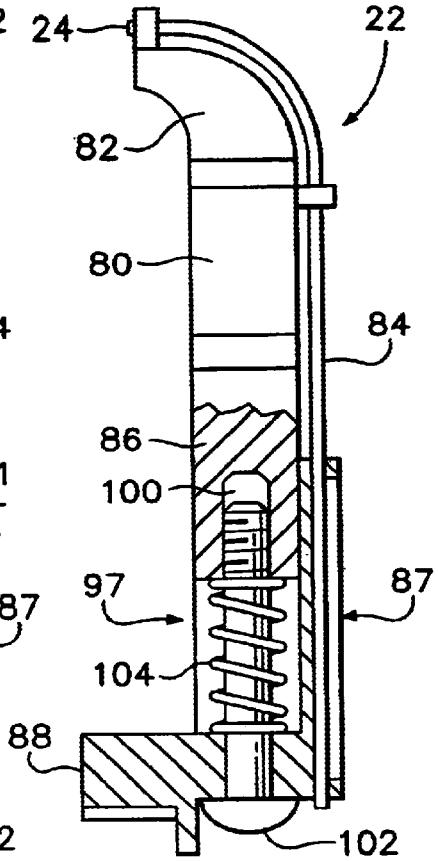
FIG. 10 is a side elevational view, similar to FIG. 9, partially broken away to show hidden detail.
Figure 11:
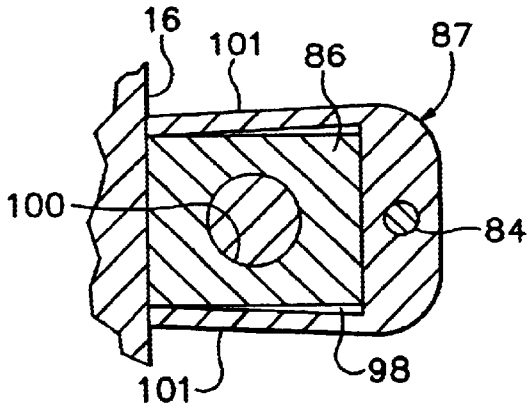
FIG. 11 is a sectional view taken on the line 11—11 of FIG. 9.
Figure 12:
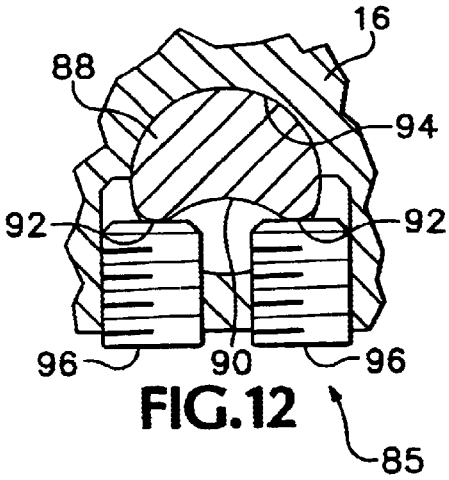
FIG. 12 is a sectional view taken on the line 12—12 of FIG. 9.

The bow sight also has a horizontal axis rotational adjustment mechanism 70 which allows the sight ring to be rotated about a fourth axis which is coaxial with the center line "A" of the mounting arm 14. The horizontal axis rotational adjustment mechanism is best seen in FIGS. 4 and 5. The guide 44 of the vertical micro adjustment mechanism 36 includes a cylindrical boss 72, which is what joins the vertical micro adjustment mechanism to the mounting arm. A bore 74, which is located in the second arm section 14*b* of the mounting arm rotatably receives the boss 72. A slot 76 extends across one side of the boss 72 and a pair of threaded passageways extends through the second arm section and opens into the bore 74 across from the slot. The threaded passageways are located on each side of the rotational center line of the boss 72. Located in the threaded passageways are screws 78. When the screws are tightened they contact pads on each end of the slot 76 and prevent the boss 72 from rotating in the bore 74. However, by loosening one of the screws and tightening the other screw slightly the boss is rotated slightly which rotates the sight ring about the fourth axis. Thus, like the vertical axis rotational mechanism the horizontal axis rotational mechanism does not have a locking system which must be unlocked to make adjustments and it allows almost infinite adjustment.

Referring now to FIGS. 1 and 7–12, the sight pins 22 have elongate bodies 80 with distal ends 82 which contain the illuminated tips 24 of elongate fiber optic lines 84 which extend down the body. The tips 24 are bent at 90° to the rest of the lines 84 so that the tips are the cylindrical ends of the lines. Thus the bodies 80 need to be oriented so that the tips face the bow. The sight pins are rotatively mounted on the sight ring. A first adjustment mechanism 85 allows the sight pins to be rotated to place the illuminated tips at the desired locations along the sight line. The proximate ends 86 of the sight pins are mounted in a holder 87 which has a cylindrical boss 88 having a relieved portion 90 with contact pads 92 at each side. Located in the base of the sight ring are a plurality of cylindrical bores 94, each of which receives the boss 88 of one sight pin 22. A pair of threaded passageways, located in the sight ring, open into each bore 94 across from the contact pads 92. Screws 96 fit into the threaded passageway and engage the contact pads. When both screws in a pair are tightened the boss will not rotate in its associated bore. However, by slightly loosening one screw in a pair and tightening the other the boss can be rotated about its center line. This permits the location of the illuminated tips 24 of the sight pins to be placed at different locations along the sight line. As with the other adjustment mechanisms, continuous adjustment is available without first having to loosen a locking system.

However, as a sight pin is rotated its illuminated tip 24 becomes displaced from the sight line 20. Second adjustment mechanisms 97 allow the illuminated tips to be moved inwardly and outwardly along the elongate axis of the sight pins to align the tips with the sight line after the sight pins have been rotated. The sight pin holder 87 has a center cavity 98 in which the proximal end 86 of the sight pin slidably fits. A threaded hole 100 is located in the base of the distal portion 86, and a screw 102 extends through an opening in the base of the sight pin holder 87 into the hole 100. A spring 104, which surrounds the screw 102, urges the sight pin outwardly in the holder. Thus, by turning or loosening the screw the tip of the sight pin can be moved inwardly or outwardly respectively. The sides 101 of the sight pin holder 87 are angled inwardly toward the open end of the holder and are separated from one another by a distance which is slightly less than the width of the distal end 82 of the sight pin. Thus, the sides 101 need to be moved outwardly for a holder 87 to receive a sight pin and the sides push against the sight pin when the sight pin is in place in it. In addition, the length of the sides 101 are slightly less than the depth of the distal end 82 of the sight pin. Thus, the bottom of the distal end of the sight pin drags on the sight ring when the sight pin is installed in the sight ring. These both cause resistance to movement of the sight pin along its longitudinal axis which prevents inadvertent movement of the sight pin.

All of the foregoing adjustment mechanisms allow very fine adjustment without having to first unlock a locking device. Thus, there will not be any inadvertent, dramatic change in the adjustment which would require the adjustment process to be started over. In addition, complete adjustment of the sight ring is possible. This allows the user to set the sight so that it is as completely accurate as possible.

The horizontal and vertical micro adjustment mechanisms can also be used on other devices where precise control of two-directional movement is required. An arrow rest is an example of where this might occur.

The procedure for adjusting the sight normally would start by adjusting the horizontal axis adjustment mechanism 70 to center the bubble in the level 18 when the longitudinal axis of the bow is vertical. A carpenter's level can be placed along side of the bow to determine when this occurs. Next the vertical axis adjustment mechanism 58 is adjusted so that the bubble remains centered in the level when the bow is angled both upwardly and downwardly at full draw. This is also done while the longitudinal axis of the bow remains vertical, which again can be accomplished by use of the carpenter's level.

The base 25 of the sight ring 16 is then attached to the tab 26 in a manner such that the horizontal and vertical locations of the sight ring are roughly correct, which can be determined by firing a few test arrows. The horizontal micro adjustment mechanism 34 is then used to more finely set the horizontal position of the sight ring. This again can be accomplished by adjusting it until arrows strike along a line which is aligned with the sight line 20. The sight pins are then adjusted so that each pin corresponds to a specific target distance. This can be done pin by pin by shooting test arrows or one pin can be set in this manner and the remaining pins can be set using an arrow speed chart. The vertical micro adjustment mechanism 36 may have to be used also to accomplish this.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An archery bow sight comprising:

(a) a mounting bracket which is configured to be attached to a bow riser;

(b) a mounting arm which is attached to said mounting bracket;

(c) a sight ring which is attached to said mounting arm;

(d) at least one sight pin which is mounted on said sight ring and has a tip which is located within said sight ring;

(e) a horizontal micro adjustment mechanism which allows said sight ring to be moved inwardly and outwardly along a first axis which is horizontal when said bow is held with its longitudinal axis vertical;

(f) a vertical micro adjustment mechanism which allows said sight ring to be moved upwardly and downwardly along a second axis which is vertical when said bow is held with its longitudinal axis vertical;

(g) a vertical axis rotational adjustment mechanism which allows said sight ring to be rotated about a third axis which bisects said mounting arm and is vertical when said bow is held with its longitudinal axis vertical; wherein (h) said horizontal and vertical micro adjustment mechanisms allow continuous movement of said sight ring without having to release a locking mechanism, while preventing unintentional movement of said sight ring along said first and second axes respectively; and (i) said vertical axis rotational adjustment mechanism allows continuous rotation of said sight ring without having to release a locking mechanism, while preventing unintentional rotation of said sight ring around said third axis.

2. The bow sight of claim 1 including a horizontal axis rotational adjustment mechanism which allows said sight ring to be rotated about a fourth axis which is coaxial with a longitudinal center line of said mounting arm.

3. The bow sight of claim 2 wherein said horizontal axis rotational adjustment mechanism allows continuous rotation of said sight ring without having to release a locking mechanism while preventing unintentional rotation of said sight ring around said fourth axis.

4. The bow sight of claim 2 wherein said horizontal axis rotational adjustment mechanism comprises:

(a) a first rotational element which is attached to said mounting arm;

(b) a second rotational element which is attached to said sight ring;

(c) one of said rotational elements has a cylindrical bore defined therein;

(d) The other of said rotational elements has a cylindrical boss projecting therefrom, which rotatably fits within said cylindrical bore, said cylindrical boss having a rotational center line and a pair of contact pads, one of said contact pads being on each side of said rotational center line;

(e) said one of said rotational elements having a pair of threaded passageways defined therein, said threaded passageways opening into said cylindrical bore, one of said threaded passageways being aligned with each of said contact pads when said cylindrical boss is located in said cylindrical bore; and (f) Screws which threadably fit within said threaded passageways.

5. The bow sight of claim 1 wherein said sight ring includes a vertical sight line and a plurality of sight pins having directionally oriented illuminated tips, including sight pin adjustment mechanisms associated with each of said sight pins which permit said illuminated tips to be arrayed in a desired orientation along said sight line.

6. The bow sight of claim 5 wherein each said sight pin has a distal end which contains said illuminated tip a proximate end which is rotatably mounted in said sight ring and said sight pin adjustment mechanism comprises:

(a) a first adjustment mechanism which allows said sight pin to be rotated to set the location of said illuminated tip along said sight line; and (b) a second adjustment mechanism which allows said sight pin to be moved along an elongate axis thereof to align said illuminated tip with said sight line when said sight pin has been rotated.

7. The bow sight of claim 6 wherein said first adjustment mechanism comprises:

(a) said sight pin has a cylindrical boss at the proximate end thereof, said cylindrical boss having a rotational center line, and a pair of contact pads, one of said contact pads being on each side of said rotational center line;

(b) said sight ring having a cylindrical bore defined therein which rotatively receives said cylindrical boss;

(c) said sight ring having a pair of threaded passageways defined therein, said threaded passageways opening into said cylindrical bore, one of said passageways being aligned with each of said contact pads when said cylindrical boss is located in said cylindrical bore; and (d) screws which threadedly fit within said threaded passageways.

8. The bow sight of claim 5 wherein said first and second adjustment mechanisms allow continuous movement of said sight pin without having to release a locking mechanism while preventing unintentional movement of said sight pin.

9. The bow sight of claim 1 wherein said vertical axis rotational adjustment mechanism comprises:

(a) said mounting arm is divided into a first arm section which is attached to said mounting bracket and a second arm section which is attached to said sight ring, said first and second mounting arms being rotatably interconnected to one another about said third axis, said arm sections overlapping one another on each side of said third axis;

(b) one of said arm sections having a pair of threaded passageways extending therethrough, one of said passageways being on each side of said third axis, said passageways opening into the other of said arm sections; and (c) screws which threadedly fit within said threaded passageways.

10. The bow sight of claim 1 wherein said horizontal and vertical micro adjustment mechanisms comprise:

(a) a housing having a cavity defined therein;

(b) a pair of rails which extend across said cavity, said rails being separated from one another;

(c) a guide having a pair of tracks defined therethrough, said tracks engaging said rails such that said guide is moveable across said cavity along said rails;

(d) a threaded rod which extends across said cavity parallel with said tracks, said threaded rod being rotatable;

(e) said guide having a threaded opening extending therethrough, said threaded opening receiving said threaded rod when said tracks are engaged with said rails such that rotation of said threaded rod causes said guide to move along said tracks; wherein (f) said tracks tightly engage said rails, and said threaded openings resist rotation of said threaded rod.

11. An archery bow sight comprising:

(a) a mounting bracket which is configured to be attached to a bow riser;

(b) a mounting arm which is attached to said mounting bracket;

(c) a sight ring which is attached to said mounting arm and is adapted to carry at least one sight pin;

(d) at least one sight pin which is mounted on said sight ring and has a tip which is located within said sight ring;

(e) a horizontal micro adjustment mechanism which allows said sight ring to be moved inwardly and outwardly along a first axis which is horizontal when said bow is held with its longitudinal axis vertical;

(f) a vertical micro adjustment mechanism which allows said sight ring to be moved upwardly and downwardly along a second axis which is vertical when said bow is held with its longitudinal axis vertical;

(g) a horizontal axis rotational adjustment mechanism which allows said sight ring to be rotated about a fourth axis which is coaxial with a longitudinal center line of said mounting arm; wherein (h) said horizontal and vertical micro adjustment mechanisms allow continuous movement of said sight ring without having to release a locking mechanism, while preventing unintentional movement of said sight ring along said first and second axes respectively; and (i) said horizontal axis rotational adjustment mechanism allows continuous rotation of said sight ring without having to release a locking mechanism, while preventing unintentional rotation of said sight ring around said fourth axis.

12. A sight ring for a bow sight comprising:

(a) a vertical sight line and a plurality of sight pins having directionally oriented illuminated tips;

(b) a sight pin adjustment mechanism, associated with each of said sight pins, which permit said illuminated tip to be arrayed in a desired orientation along said sight line; wherein (c) each said sight pin has a distal end which contains said illuminated tip and a proximal end which is rotatably mounted in said sight ring; and (d) said sight pin adjustment mechanism comprises:

(i) a first adjustment mechanism which allows said sight pin to be rotated to set the location of said illuminated tip along said sight line; and (ii) a second adjustment mechanism which allows said sight pin to be moved along an elongate axis thereof to align said illuminated tip with said sight line when said sight pin has been rotated wherein said first and second adjustment mechanisms allow continuous movement of said sight pin without having to release a locking mechanism, while preventing unintentional movement of said sight pin.

13. A micro adjustment device comprising:

(a) a housing having a cavity defined therein;

(b) a pair of rails which extend across said cavity, said rails being separated from one another;

(c) a guide having a pair of tracks defined therethrough, said tracks engaging said rails such that said guide is moveable across said cavity along said rails;

(d) a threaded rod which extends across said cavity parallel with said tracks, said threaded rod being rotatable;

(e) said guide having a threaded opening extending therethrough, said threaded opening receiving said threaded rod when said tracks are engaged with said rails such that rotation of said threaded rod causes said guide to move along said tracks; wherein (f) said tracks tightly engage said rails; and said threaded opening resists rotation of said threaded rod without rotational play.

* * * * *